US009623476B2

(12) United States Patent
Choda et al.

(10) Patent No.: US 9,623,476 B2
(45) Date of Patent: Apr. 18, 2017

(54) METHOD FOR HEATING FORGING DIE DEVICE

(71) Applicant: Kobe Steel, Ltd., Hyogo (JP)

(72) Inventors: Takashi Choda, Kobe (JP); Yukihide Honda, Kobe (JP); Shigeomi Araki, Takasago (JP); Shogo Murakami, Kobe (JP); Soichiro Kojima, Takasago (JP); Yusuke Momota, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 96 days.

(21) Appl. No.: 14/376,309

(22) PCT Filed: Apr. 2, 2013

(86) PCT No.: PCT/JP2013/060119

§ 371 (c)(1),
(2) Date: Aug. 1, 2014

(87) PCT Pub. No.: WO2013/151063

PCT Pub. Date: Oct. 10, 2013

(65) Prior Publication Data

US 2015/0013421 A1 Jan. 15, 2015

(30) Foreign Application Priority Data

Apr. 5, 2012 (JP) ..... 2012-086398

(51) Int. Cl.
*B21J 1/06* (2006.01)
*B21J 13/03* (2006.01)
(Continued)

(52) U.S. Cl.
CPC ..... *B21J 1/06* (2013.01); *B21D 22/022* (2013.01); *B21J 13/03* (2013.01); *B21J 13/085* (2013.01); *B21K 29/00* (2013.01)

(58) Field of Classification Search
CPC ..... B21J 1/06; B21J 5/00; B21J 5/02; B21J 5/025; B21J 9/08; B21J 13/03;
(Continued)

(56) References Cited

U.S. PATENT DOCUMENTS 4,055,975 A * 11/1977 Serfozo ..... B21J 5/02 29/DIG. 45
4,444,039 A * 4/1984 Asari ..... B21J 9/02 100/918
(Continued)

FOREIGN PATENT DOCUMENTS

GB 2140339 A 11/1984
JP S60-80028 U 6/1985
(Continued)

OTHER PUBLICATIONS

The extended European search report issued by the European Patent Office on Jan. 8, 2016, which corresponds to European Patent Application No. 13772997.6-1702 and is related to U.S. Appl. No. 14/376,309.
(Continued)

*Primary Examiner* — Peter DungBa Vo
*Assistant Examiner* — Joshua D Anderson
(74) *Attorney, Agent, or Firm* — Studebaker & Brackett PC

(57) ABSTRACT

A forging die device is configured in such a manner that die heating heater plates 11, 21 are disposed respectively between a die 1 which is held at the outer periphery by die holders 12, 22, and die holding means 14*a*, 24*a* composed of heat insulating plates 13, 23 and die plates 14, 24, and the die holders, the die holding means and the die plates are integrated together. After the preheated die 1 is placed on the heated die holding means, the die 1 is heated by heating
(Continued)

means, and forming surfaces 10*a*, 20*a* of the die are heated to a required temperature immediately before forging.

18 Claims, 4 Drawing Sheets

(51) Int. Cl.
*B21J 13/08* (2006.01)
*B21D 22/02* (2006.01)
*B21K 29/00* (2006.01)

(58) Field of Classification Search
CPC ..... B21J 13/085; B21J 17/00; B21J 17/02; B21K 29/00; B21D 22/022; B21D 22/208; B21D 37/14; B21D 37/16
USPC ..... 72/342.1, 342.4–342.8, 342.92, 342.94, 72/364, 700
See application file for complete search history.

(56) References Cited

U.S. PATENT DOCUMENTS 4,531,396 A * 7/1985 MacNitt, Jr. ..... B21J 13/02 29/894.34
6,553,804 B2 * 4/2003 Convert ..... B21D 37/14 100/301
2003/0056562 A1 3/2003 Kamano

FOREIGN PATENT DOCUMENTS

JP H02-148744 U 12/1990
JP H03-77736 A 4/1991
JP 2002-096134 A 4/2002
JP 2003-103331 A 4/2003

OTHER PUBLICATIONS

International Search Report; PCT/JP2013/060119; Jul. 2, 2013.
Written Opinion of the International Searching Authority; PCT/JP2013/060119; Jul. 2, 2013.

* cited by examiner

METHOD FOR HEATING FORGING DIE DEVICE

TECHNICAL FIELD

The present invention relates to a method for heating a die device used for hot forging of hardly workable materials.

BACKGROUND ART

In forging of hardy workable metal materials such as titanium alloy and Ni-based alloy, as a method for hot precise die forging, an isothermal forging method of performing forging by holding die temperature at the same level as the heating temperature of a forging material and controlling distortion rate within a fixed range is increasingly applied. Further, a hot die forging method of performing forging by controlling the distortion rate while bringing the die temperature closer to the heating temperature of the forging material is also increasingly applied.

As a die structure used for the above-mentioned isothermal forging or hot die forging, a hot forging press apparatus 71 as shown in FIG. 4 is given as an example. In the hot forging press apparatus 71, dies 73, 74 heated by a heat source 72, for example, an induction heater or the like are mounted on die plates (die holding means) 77, 78 fixed to base plates 75, 76 of a press apparatus body. Heat insulating structural members 79, 80 are disposed respectively between the dies 73, 74 and the die plates 77, 78 to prevent the transfer of heat from the dies 73, 74 heated by the heat source 72 toward the die plates 77, 78 and the press apparatus body. In the above-mentioned hot precise die forging of hardly workable materials, the upper and lower dies are heated to a temperature close to the heating temperature of the forging material. Therefore, from the viewpoint of formability and operation performance, the die temperature must be accurately and efficiently controlled. The accurate control of the die temperature requires consideration of heating of the die device including not only the dies 73, 74 but also the die plates 77, 78.

On the other hand, means for efficiently heating a forging die is disclosed, for example, in Patent Document 1 . In a heating jig used in the heating method of Patent Document 1, a heater is provided in the middle between a first die (upper die) and a second die (lower die) disposed oppositely to each other. Further, one surface of the first die (upper die) and the second die (lower die) is formed in a shape taken along a forging surface of the first die, and the other surface is formed in a shape taken along a forging surface of the second die.

CITATION LIST

Patent Document

Patent Document 1: JP 2002-96134 A

SUMMARY OF THE INVENTION

Technical Problem

However, in a conventional die heating method shown, for example, in FIG. 4, in which the dies are heated by the heat source 72 disposed around the upper and lower dies 73, 74, the die temperature can not be necessarily controlled with high accuracy and efficiency. Therefore, an intended dimensional accuracy or surface quality of a shaped product cannot be attained in some cases, and a relatively long time is also required for the heating to a target die temperature. Thus, there is room for improvement from the point of operability.

In the heating method disclosed in Patent Document 1, a heating jig must be prepared for each forging surface shape of dies, or for each shape of forged products. Therefore, this method is complicated and has room for improvement from the viewpoint of heating cost.

An object of the present invention is thus to provide a method for heating a die device including a holding jig, for accurately and efficiently heating a die to a target heating temperature in forging of a hardly workable material such as titanium alloy or Ni-based alloy.

Solution to Problem

To solve the above-mentioned problems, the present invention adopts the following configurations.

A method for heating a forging die device according to the present invention is a method for heating a forging die device which is provided with a die having an upper die and a lower die, and a die holding unit for supporting at least one die of the upper and lower dies and which is configured to perform forging by heating the die after fixing the die holding unit to a press body, and the method is characterized by preheating at least the one of the upper and lower dies; placing the preheated die on the heated die holding unit and then heating the preheated die by a heating unit; and heating forming surfaces of the die to a required temperature by heating means different from the heating unit for the die.

In the method for heating a forging die device, preferably, the die holding unit includes a heat insulating plate and a die plate, the die holding unit is heated, and the forming surfaces of the die are heated immediately before forging.

In the method for heating a forging die device, preferably, the die is held by a die holder which surrounds the outer periphery of the die, the die holder is supported by the die holding unit, and the die holder, the die holding unit and the die plate are integrated together by a fastening unit having a tie rod or bolt and a nut while inserting a disc spring to both sides or one side thereof.

In the method for heating a forging die device, preferably, the die holding unit and the base plate are integrated together by a fastening unit including a tie rod or bolt and a nut, each of the dies is fixed to the press body by a die fixing unit which abuts on the outer periphery of the die and detachably fixes and holds the die, and the outer periphery of the die is heated by a flexible pad heater or an infrared heater.

In the method for heating a forging die device, preferably, a heater plate with a plurality of built-in sheath heaters is disposed between the die and the die holding unit in such a manner that a surface opposite to the product forming surface of the die abuts thereon.

In the method for heating a forging die device, preferably, the forming surfaces of the die are heated by infrared heaters.

Advantageous Effects of Invention

In the present invention, at least one die of the upper die and lower die for molding a forging material is preheated, the die holding means and the die holder are also heated as well as the die, and the forming surfaces of the die are heated to a required temperature immediately before forging. By this means, in forging of a hardly workable material such as titanium alloy or Ni-based alloy, the time required for heating to a necessary die temperature can be reduced, compared in the past, and improvement in forging operation efficiency and reduction in heating cost can be also attained. In the present invention, at least the one die of the upper and lower dies is preheated separately before it is placed on the die holding means, or before it is incorporated to a press. Since this enables execution of forging preparation operation in parallel with this preheating of the die, real operation performance is also improved. Further, since the forming surfaces of the die immediately before forging are heated using the heating means different from the die heating means, necessary portions of the forming surfaces can be efficiently heated.

DESCRIPTION OF EMBODIMENTS

Figure 1:
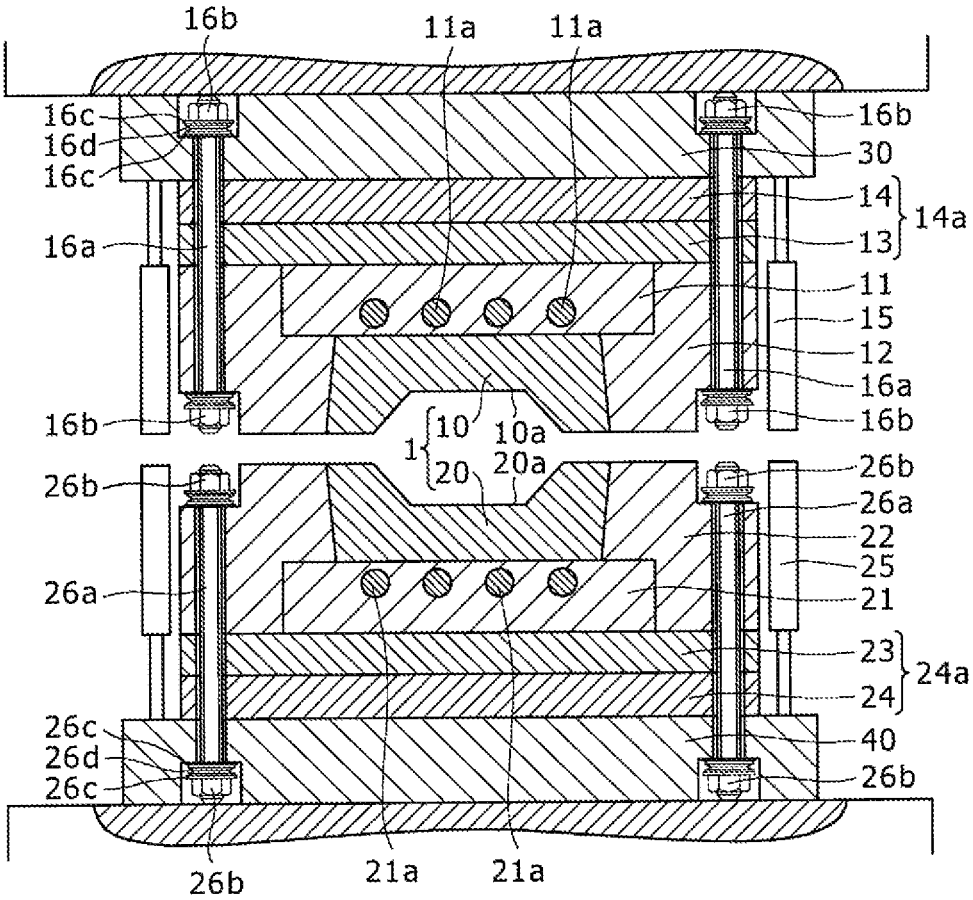
FIG. 1 is an illustrative view (cross-sectional view) showing a die device for hot forging according to one embodiment of the present invention.

Embodiments of the present invention will be described below in reference to the drawings. FIG. 1 is a cross-sectional view schematically showing the configuration of a forging die device according to one embodiment of the present invention.

As shown in FIG. 1, a die 1 is composed of an upper die 10 and a lower die 20.

The upper die 10 side is described first. A heater plate 11 is disposed in such a manner that a surface opposite to the forging material side of the upper die 10 (the reverse side of the upper die 10) abuts thereon. A sheath heater 11*a* is inserted to each of a plurality of heater insert holes formed within the heater plate 11 to heat the upper die 10.

A die holder 12 surrounds the outer periphery of the upper die 10 and holds the upper die 10. In forging, the upper die 10 which is heated by a heating furnace is fitted to the inside of the die holder 12, and fixed to the die holder 12 by use of, for example, pins not shown or the like. In this way, the upper die 10 side has a so-called "nested structure". An infrared heater 15 surrounds the outer periphery of the die holder 12 with a narrow gap therefrom, and functions as a die holder heating heater for heating (radiation-heating) the die holder 12.

A die plate 14 supports the above-mentioned upper die 10, heater plate 11 and die holder 12 through a heat insulating plate 13. A die holding means for the upper die 10 is formed by the heat insulating plate 13 and the die plate 14. A base plate 50 is fixed to a lifting and lowering-side member (slider) of a pressing machine not shown. The upper half of the die device including the die holder 12, the heater plate 11, the heat insulating plate 13 and the die plate 14 is mounted on the base plate 50 in an integrated manner by use of tie rods 16*a*, nuts 16*b*, washers 16*c* and disc springs 16*d*.

The lower die 20 side is then described. A heater plate 21 is disposed in such a manner that a surface opposite to the forging material side of the lower die 20 (the reverse side of the lower side 20) abuts thereon. A sheath heater 21*a* is inserted to each of a plurality of heater insert holes formed within the heater plate 21 to heat the lower die 20.

A die holder 22 surrounds the outer periphery of the lower die 20 and holds the lower die 20. In forging, the lower die 20 which is preliminarily heated by the heating furnace is fitted to the inside of the die holder 22, and fixed to the die holder 22 by use of, for example, pins not shown or the like. In this way, the lower die 20 side has a so-called "nested structure". An infrared heater 25 surrounds the outer periphery of the die holder 22 with a narrow gap therefrom, and functions as a die holder heating heater for heating (radiation-heating) the die holder 22.

A die plate 24 supports the above-mentioned lower die 20, heater plate 21 and die holder 22 through a heat insulating plate 23. A die holding means 24*a* for the lower die 20 is formed by the heat insulating plate 23 and the die plate 24. A base plate 60 is fixed to a fixed-side member (bolster) of the pressing machine. The lower half of the die device including the die holder 22, the heater plate 21, the heat insulating plate 23 and the die plate 24 is mounted on the base plate 60 in an integrated manner by use of tie rods 26*a*, nuts 26*b*, washers 26*c*, and disc springs 26*d* . In FIG. 1, a knock-out for ejecting a forged product and the like are not shown.

In this embodiment, the upper and lower dies 10, 20 are formed in a disk shape having a cavity portion, and made of, for example, Ni-based heat resistant superalloy. The heater plate 11, 21 are formed in a disk shape, and made of, for example, Ni-based superalloy. The die holder 12, 22 are formed in an annular shape and made of, for example, SKD 61 (hot work tool steel). The heat insulating plates 13, 23 are formed in an annular shape, and made of, for example, heat-resisting high strength steel sheet and ceramics such as silicon nitride or zirconia filled therein. The die plates 14, 24 are formed in a disk shape, and made of, for example, SKD 61 (hot work tool steel) similarly to the die holders 12, 22.

In the thus-configured forging die device, the die 1 composed of the upper die 10 and the lower die 20 is guided to the pressing machine not shown after preheated to a predetermined temperature by the heating furnace or the like. The die 1 is fitted to the inside of the die holders 12, 22 in such a manner that its die reverse sides abut on the heater plates 11, 21 respectively, and is fixed to the die holders 12, 22 by use of, for example, pins not shown or the like.

The die 1 is fixed to the die holders 12, 22 and then heated to a required temperature (a temperature close to the temperature of a forging material to be forged) by the heater plates 11, 21. The die 1 is in contact with the die holders 12, 22 with zero clearance by thermally expanding within an elastically deformable range by heating. The die holding means composed of the die holders 12, 22, the heat insulating plates 13, 23, and the die plates 14, 24 are heated (radiation heated by infrared heaters), for example, in a temperature range of 400 to 500° C. by the infrared heaters 15, 25. Immediately before forging, the forming surfaces 10*a* and 20*a* of the upper die and the lower die are heated to a preset required temperature by heating means different from the heater plates 11, 21 that are the die heating means, for example, by heating means such as infrared heaters. Thereafter, the forging material composed of titanium alloy, Ni-based alloy or the like, that is a hardly workable metal material, is set in the die 1 after preliminarily heated to a predetermined forging temperature by a heating furnace or the like. In this way, high-temperature forging of the forging material is performed. The die holding means are also heated, whereby the transfer of heat from the high-temperature side of the dies 10, 20 to the die holding means is suppressed. Therefore, the heating of the die holding means can contribute to reduction in the time required for heating the dies 10, 20 to the required temperature.

According to the method for heating a forging die device of the present invention, the upper die and lower die for molding the forging material are preheated, the die holding means and the die holders are also heated as well as these dies, and the forming surfaces of the die are also heated to the required temperature immediately before forging. Since this enables efficient heating of necessary portions of the forming surfaces of the die, the time required for the heating to the necessary die temperature in forging of the hardly workable material such as titanium alloy or Ni-based alloy can be reduced, compared with in the past. Further, improvement in forging operation efficiency and reduction in heating cost can be also attained.

Figure 2:
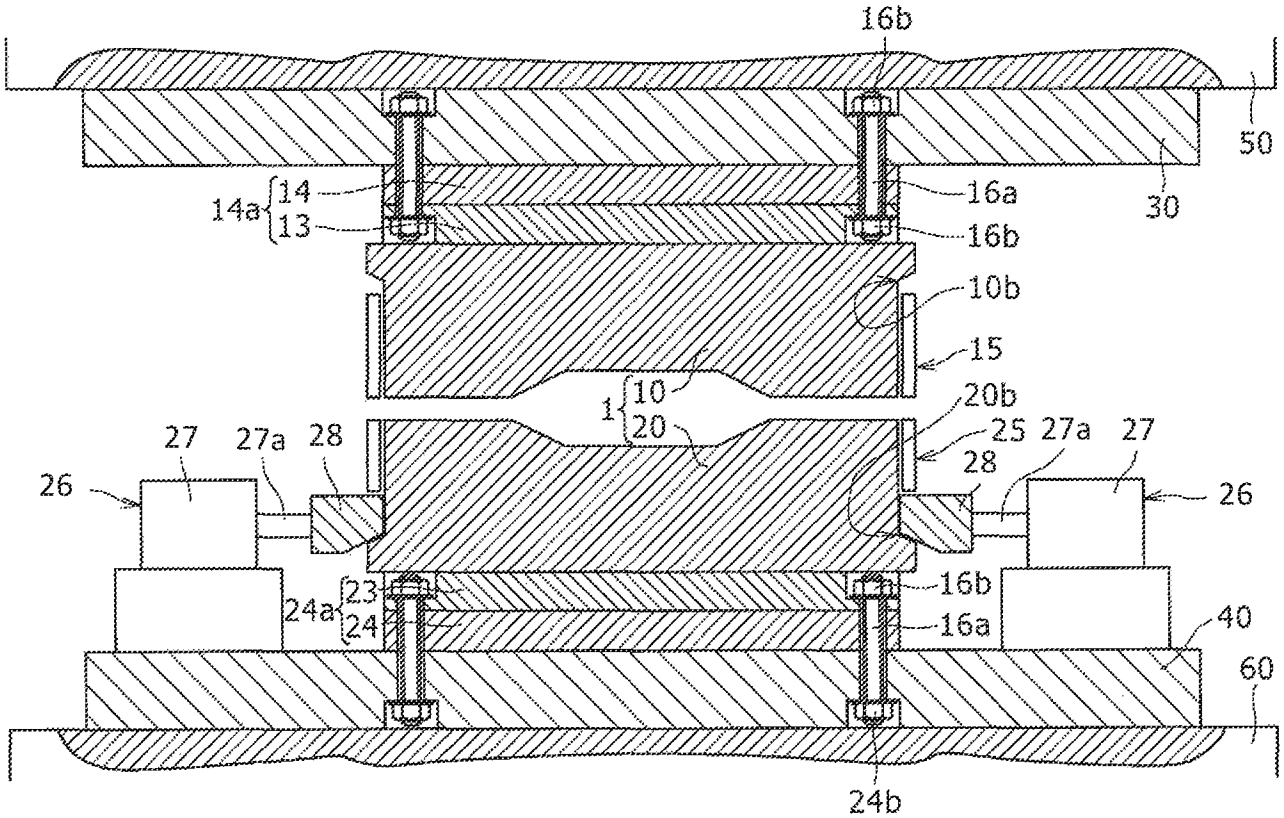
FIG. 2 is an illustrative view (cross-sectional view) for a lower die side in a die device for hot forging according to another embodiment of the present invention.
Figure 3:
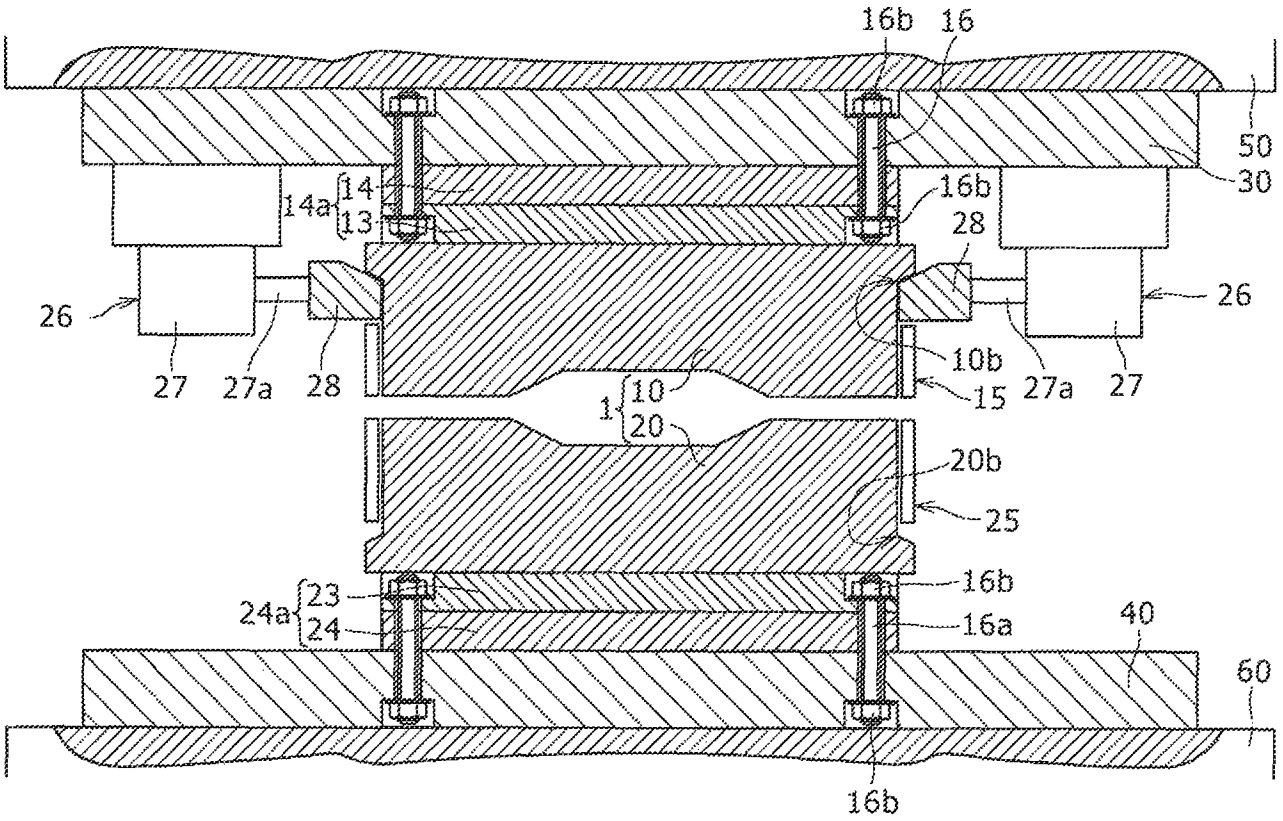
FIG. 3 is an illustrative view (cross-sectional view) for an upper die side in a die device for hot forging according to another embodiment.
Figure 4:
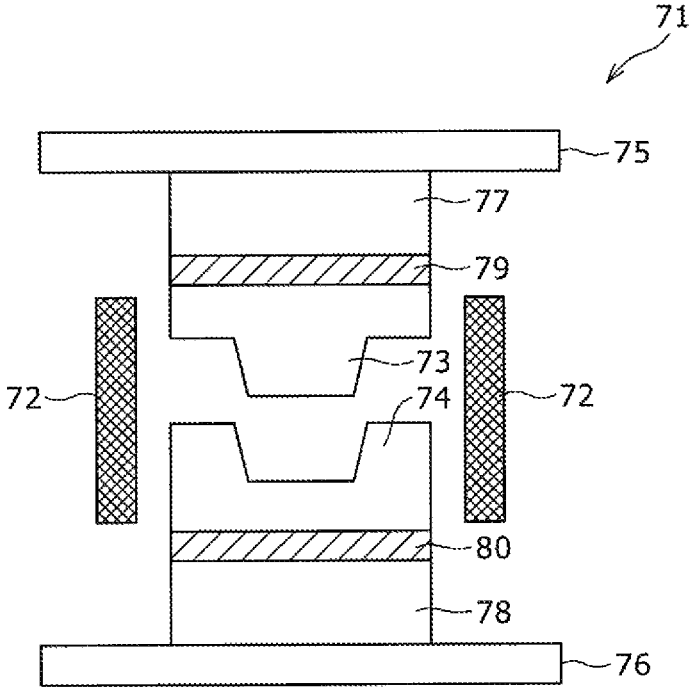
FIG. 4 is an illustrative view (cross-sectional view) showing a die device for hot forging according to the related art.

FIG. 2 is a cross-sectional view schematically showing the configuration of a forging die device in another embodiment of the present invention, and FIG. 3 is a cross-sectional view schematically showing an alternative configuration of the forging die device shown in FIG. 2.

As shown in FIGS. 2 and 3, a die 1 is composed of an upper die 10 and a lower die 20. The upper die 10 has a product forming surface, and includes, in the outer periphery thereof, an engagement portion 10*b* formed by a top-to-bottom vertical surface and an inclined surface. Similarly, the lower die 20 has a product forming surface, and includes, in the outer periphery thereof, an engagement portion 20*b* formed by a top-to-bottom vertical surface and an inclined surface.

The lower die 20 side is described first in reference to FIG. 2. A heat insulating plate 23 is disposed in such a manner that it abuts on a surface opposite to the product forming surface of the lower die 20 (the reverse side of the lower die 20). A die plate 24 supports the lower die 20 through the heat insulating plate 23. Similarly to the die device shown in FIG. 1, a die holding means 24*a* for the lower die 20 is formed by the heat insulating plate 23 and the die plate 24.

A base plate 60 supports the lower die 20 through the die holding means 24*a* . In the die device of this embodiment, the heat insulating plate 23, the die plate 24 and the base plate 60 are fastened in an integrated manner by use of tie rods 16*a*, nuts 16*b* and the like. The base plate 60 is fixed to a fixed-side member of a press body by use of, for example, bolts or the like.

An infrared heater 25 heats the outer periphery of the lower die 20. The infrared heater 25 is supported by, for example, a support member not shown, which is fixed to the base plate 60. As the heater for heating the outer periphery of the die, a flexible pad heater such as a pad electric heater can be used instead of the infrared heater.

A pair of die clamping devices 26 is disposed oppositely to each other on the base plate 60. The die clamping device 26 includes a hydraulic cylinder 27, and a clamp head 28 fixed to a tip portion of a piston rod 27*a* of the hydraulic cylinder 27. The hydraulic cylinder 27 is fixed to the base plate 60 through a base block. The clamp head 28 has, at its tip portion, a shape corresponding to the engagement portion 20*b* of the lower die 20. The clamp head 28 abuts on the engagement portion 20*b*, and presses the lower die 20 toward the base plate 60. The pair of die clamping devices 26 constitutes a die fixing unit which abuts on the outer periphery of the lower die 20 and detachably fixes and holds the lower die 20.

The upper die 10 side is then described in reference to FIG. 3. A heat insulating plate 13 is disposed in such a manner that it abuts on a surface opposite to the product forming surface of the upper die 10 (the reverse side of the upper die 10). A die plate 14 supports the upper die 10 through the heat insulating plate 13. A die holding means 14*a* for the upper die 10 is formed by the heat insulating plate 13 and the die plate 14.

A base plate 30 supports the upper die 10 through the die holding means. In this embodiment, the heat insulating plate 13, the die plate 14 and the base plate 30 are fastened in an integrated manner by use of die rods 16*a*, nuts 16*b* and the like. The base plate 30 is fixed to a lifting and lowering-side (movable-side) member 50 of the press body by use of, for example, bolts or the like.

An infrared heater 15 heats the outer periphery of the upper die 10. The infrared heater 15 is supported by, for example, a support member not shown, which is fixed to the base plate 30.

A pair of die clamping devices 26 is disposed oppositely to each other on the base plate 30 similarly to the lower die 20 side. The die clamping device 26 includes a hydraulic cylinder 27 and a clamp head 28 fixed to a tip portion of a piston rod 27*a* of the hydraulic cylinder 27. The hydraulic cylinder 27 is fixed to the die plate 14 through a base block. The clamp head 28 has, at its tip portion, a shape corresponding to the engagement portion 10*b* of the upper die 10. The clamp head 28 abuts on the engagement portion 10*b* and presses the upper die 10 toward the die plate 14. The pair of die clamping devices 26 constitutes a die fixing unit which abuts on the outer periphery of the upper die 10 and detachably fixes and holds the upper die 10. The pair of die clamping devices 26 for the upper die 10 and the pair of die clamping device 26 for the lower die 20 constitute a die fixing unit which abuts on the outer periphery of the die 1 and detachably fixes and holds the die 1. In FIGS. 2 and 3, a knock-out mechanism for ejecting a forged product and the like are not shown.

The upper and lower dies 10, 20 in the die device of this embodiment have product forming surfaces, and are formed in a disk shape. The material of the dies 10, 20 and the materials of the heat insulating plates 13, 23 and the die plates 14, 24 are the same as in the die device of the embodiment shown in FIG. 1.

In the thus-configured forging die device, the die 1 composed of the upper die 10 and the lower die 20 is preliminarily heated to a predetermined temperature by the heating furnace and then guided to the pressing machine. When the high-temperature lower die 20 is placed on the die holding means 24*a*, the piston rods 27*a* of a pair of hydraulic cylinders 27 are moved forward from both sides of the lower die 20 toward the lower die 20. The clamp heads 28 are allowed to abut on the engagement portion 20*a* of the lower die 20 by this forward movement to press the lower die 20 onto the base plate 23. By this means, as shown in FIG. 2, the preheated lower die 20 can be fixed to and held on the base plate 23.

On the other hand, when the high-temperature upper die 10 is disposed just under the die holding means 14*a*, the piston rods 27*a* of a pair of hydraulic cylinders 27 are moved forward from both sides of the upper die 10 toward the upper die 10. The clamp heads 28 are allowed to abut on the engagement portion 10*b* of the upper die 10 by this forward movement to press the upper die 10 onto the base plate 30. By this means, as shown in FIG. 3, the preheated upper die 10 can be fixed to and held on the base plate 30.

When the die 1 is installed in the pressing machine in this way, the die 1 is heated from the outer peripheral side by the infrared heaters 15, 25. The temperature of the die 1 is adjusted to a required temperature (a temperature close to the temperature of a forging material to be forged). In this die heating process, the transfer of heat from the upper die 10 side to the base plate 13 side is prevented by the heat insulating plate 13, and the transfer of heat from the lower die 20 side to the base plate 23 side is similarly prevented by the heat insulating plate 23. The product forming surfaces 10*a*, 20*a* of the die 1 are heated to a preset required temperature (a temperature substantially equal to the temperature of the forging material to be forged) by heating means such as infrared heaters different from the heating means 15, 25 for the outer periphery of the die 1. Thereafter, the forging material composed of titanium alloy, Ni-based alloy or the like, that is a hardly workable metal material, is set in the die 1 after preliminarily heated to a predetermined forging temperature by a heating furnace or the like. In this way, high-temperature forging of the forging material is performed. Similarly to the case of the lower die 20, as the die outer periphery heating heater, a flexible pad heater such as a pad electric heater can be used instead of the infrared heater.

In this way, the forging die device in this embodiment is provided with the infrared heaters or flexible pad heaters for heating the outer periphery of the die 1, separately from the die 1. Therefore, the die 1 can be preliminarily preheated by the heating furnace when high-temperature forging is performed by heating the die 1 to the same degree as the temperature of the forging material. Further, the die 1 can be rapidly heated up to the predetermined temperature (substantially the same temperature as the temperature of the forging material to be forged) by heating, immediately before forging, the forming surfaces 10*a* and 20*a* of the upper die and lower die to a required temperature by the heating means different from the heating means for the outer periphery of the die 1.

For a die for large-sized forged product or the like, a heater plate with a plurality of built-in sheath heaters may be disposed each between the upper die 10 and lower die 20 and the die holding means 14*a*, 24*a*. According to such heater plates, the surfaces opposite to the forming surfaces 10*a* and 20*a* of the upper die 10 and lower die 20 can be heated. The application of the die heating method of this embodiment to such a die device can contribute to improvement in the productivity of a large-sized forged product.

In the above-mentioned embodiments, examples in which the die holding means and the heater plates are provided on both the upper and lower dies are shown. However, these means may be provided on any one of the upper and lower dies.

Having described each embodiment of the present invention, the present invention is never limited to the above-mentioned embodiments, and various changes and modifications of the present invention can be made without departing from the scope of the claims. The present application is based on Japanese Patent Application (Application No. 2012-086398), and the content hereof is embraced herein as reference.

EXPLANATION OF REFERENCE NUMERALS

1 Die
10 Upper die
20 Lower die
10*a*, 20*a* Forming surface of upper die and lower die
11, 21 Heater plate
11*a*, 21*a* Sheath heater
12, 22 Die holder
13, 23 Heat insulating plate
14, 24 Die plate
14*a*, 24*a* Die holding means (die holder)
15, 25 Infrared heater (die holder heating heater)
30, 40 Base plate

The invention claimed is:

1. A method for heating a forging die device which comprises a die having an upper die and a lower die, and a die holding unit for supporting at least one die of the upper and lower dies, and which is configured to perform forging by heating the die after fixing the die holding unit to a press body, the method comprising:

preheating at least the one die of the upper and lower dies;

placing the preheated die on the die holding unit and then heating the preheated die by a heating unit located in the die holding unit;

after the step of placing the preheated die on the die holding unit and then heating the preheated die by the heating unit, heating forming surfaces of the upper and lower dies to a required temperature by heating means different from the heating unit, the heating means different from the heating unit surrounding the outer periphery of the die holding unit with a gap therefrom, and after the step of heating the forming surfaces of the upper and lower dies to the required temperature by the heating means different from the heating unit, placing a forging material between the upper and lower dies to thereby perform forging of the forging material by bringing the forming surfaces of the upper and lower dies into contact with the forging material.

2. The method for heating a forging die device according to claim 1, wherein the die holding unit includes a heat insulating plate and a die plate.

the die holding unit is heated, and the forming surfaces of the preheated die are heated immediately before forging.

3. The method for heating a forging die device according to claim 2, wherein the preheated die is held by a die holder which surrounds an outer periphery of the die;

the die holder is supported by the die holding unit; and the die holder, the die holding unit and the die plate are integrated together by a fastening unit including a tie rod or bolt and a nut while inserting a disc spring to both end sides or one end side thereof.

4. The method for heating a forging die device according to claim 3, wherein the heating unit is a heater plate with a plurality of built-in sheath heaters that is disposed between the preheated die and the die holding unit in such a manner that a surface opposite to the forming surface of the preheated die abuts thereon.

5. The method for heating a forging die device according to claim 3, wherein the forming surfaces of the upper and lower dies are heated by the heating means different from the heating unit being infrared heaters.

6. The method for heating a forging die device according to claim 2, wherein the die holding unit and a base plate are integrated together by a fastening unit including a tie rod or bolt and a nut;

each of the upper and lower dies is fixed to the press body by a die fixing unit which abuts on an outer periphery of the upper or lower die and detachably fixes and holds the upper or lower die; and the outer periphery of the preheated die is heated by the heating means different from the heating unit that is a flexible pad heater or an infrared heater.

7. The method for heating a forging die device according to claim 6, wherein the heating unit is a heater plate with a plurality of built-in sheath heaters that is disposed between the preheated die and the die holding unit in such a manner that a surface opposite to the forming surface of the preheated die abuts thereon.

8. The method for heating a forging die device according to claim 6, wherein the forming surfaces of the upper and lower dies are heated by the heating means different from the heating unit being infrared heaters.

9. The method for heating a forging die device according to claim 2, wherein the forming surfaces of the upper and lower dies are heated by the heating means different from the heating unit being infrared heaters.

10. The method for heating a forging die device according to claim 1, wherein the preheated die is held by, a die holder which surrounds an outer periphery of the die;

the die holder is supported by the die holding unit; and the die holder, the die holding unit and the die plate are integrated together by a fastening unit including a tie rod or bolt and a nut while inserting a disc spring to both end sides or one end side thereof.

11. The method for heating a forging die device according to claim 10, wherein the heating unit is a heater plate with a plurality of built-in sheath heaters that is disposed between the preheated die and the die holding unit in such as manner that a surface opposite to the forming surface of the preheated die abuts thereon.

12. The method for heating a forging die device according to claim 11, wherein the forming surfaces of the upper and lower dies are heated by the heating means different from the heating unit being infrared heaters.

13. The method for heating a forging die device according to claim 10, wherein the forming surfaces of the upper and lower dies are heated by the heating means different from the heating unit being infrared heaters.

14. The method for heating a forging die device according to claim 1, wherein the die holding unit and a base plate are integrated together by a fastening unit including a tie rod or bolt and a nut;

each of the upper and lower dies is fixed to the press body by a die fixing unit which abuts on an outer periphery of the upper or lower die and detachably fixes and holds the upper or lower die; and the outer periphery of the preheated die is heated by the heating means different from the heating unit that is a flexible pad heater or an infrared heater.

15. The method for heating a forging die device according to claim 14, wherein the heating unit is a heater plate with a plurality of built-in sheath heaters that is disposed between the preheated die and the die holding unit in such a manner that a surface opposite to the forming surface of the preheated die abuts thereon.

16. The method for heating a forging die device according to claim 14, wherein the forming surfaces of the upper and lower dies are heated by the heating means different from the heating unit being infrared heaters.

17. The method for heating a forging die device according to claim 1, wherein the forming surfaces of the upper and lower dies are heated by the heating means different from the heating unit being, infrared heaters.

18. The method for heating a forging die device according to claim 1, wherein the forging material is preheated to a predetermined forging temperature before being placed between the upper and lower dies.

* * * * *